US005782067A

United States Patent [19]

Fuss et al.

[11] Patent Number: 5,782,067

[45] Date of Patent: Jul. 21, 1998

[54] BAG SEALER AND CUTTER FOR USE IN PACKAGING LOOSE FILL PACKAGING MATERIALS

[75] Inventors: Gunter G. Fuss, San Mateo; Vladimir Yampolsky, San Carlos, both of Calif.

[73] Assignee: Free-Flow Packaging International, Inc., Redwood City, Calif.

[21] Appl. No.: 816,114

[22] Filed: Mar. 11, 1997

Related U.S. Application Data

[63] Continuation-in-part of Ser. No. 766,156, Dec. 12, 1996, which is a continuation-in-part of Ser. No. 673,296, Jun. 28, 1996.

[51] Int. Cl.[6] ..... B65B 9/15; B65B 9/18; B65B 51/06

[52] U.S. Cl. ..... 53/576; 53/567; 53/137.2; 53/139.1

[58] Field of Search ..... 53/451, 459, 481, 53/138.3, 137.2, 567, 576, 472, 552, 390, 372.5, 139.1

[56] References Cited

U.S. PATENT DOCUMENTS

| | | | |
|---|---|---|---|
| 2,908,123 | 10/1959 | Muller et al. | 53/567 X |
| 3,141,277 | 7/1964 | Johnston | 53/137.2 X |
| 3,281,089 | 10/1966 | Krueger et al. . | |
| 3,461,648 | 8/1969 | Ashton | 53/576 |
| 3,726,060 | 4/1973 | McMillan | 53/576 X |
| 3,732,662 | 5/1973 | Paxton | 53/138.3 |
| 3,945,171 | 3/1976 | Marietta, Jr. et al. | 53/576 X |
| 4,446,677 | 5/1984 | Kokido | 53/576 X |
| 4,550,553 | 11/1985 | Gaither | 53/552 X |
| 4,718,220 | 1/1988 | Van Rosendal et al. | 53/137.2 X |
| 4,922,650 | 5/1990 | Akao et al. | 53/552 X |
| 4,938,007 | 7/1990 | Sperry | 53/472 X |
| 4,939,885 | 7/1990 | Steinke | 53/552 X |
| 4,999,975 | 3/1991 | Willden et al. | 53/552 X |
| 5,109,648 | 5/1992 | Evans | 53/567 X |
| 5,408,791 | 4/1995 | Marie | 53/567 X |
| 5,410,861 | 5/1995 | Medlock | 53/137.2 X |
| 5,600,934 | 2/1997 | Van Rosendal et al. | 53/389.3 X |

FOREIGN PATENT DOCUMENTS

| | | |
|---|---|---|
| 0456144A1 | 11/1991 | European Pat. Off. . |
| 1196228 | 5/1961 | France . |
| 93147317 U | 2/1994 | Germany . |
| 1564397 | 4/1980 | United Kingdom . |
| WO9406687 | 3/1994 | WIPO . |

*Primary Examiner*—Horace M. Culver
*Attorney, Agent, or Firm*—Flehr Hohbach Test Albritton & Herbert LLP

[57] ABSTRACT

Bag sealer and cutter having a guide for directing a portion of flexible tubing which has been gathered together along a predetermined path in a direction which is generally perpendicular to the axis of the tubing, a pair of tape applicators positioned side-by-side for simultaneously applying bands to the gathered together portion of the tubing as the tubing travels along the path, and a knife disposed in the path of the tubing after the applicators for cutting the tubing apart between the bands of tape.

15 Claims, 11 Drawing Sheets

BAG SEALER AND CUTTER FOR USE IN PACKAGING LOOSE FILL PACKAGING MATERIALS

This is a continuation-in-part of Ser. No. 08/766,156, filed Dec. 12, 1996, which is a continuation-in-part of Ser. No. 08/673,296, filed Jun. 28, 1996.

This invention pertains generally to apparatus for packaging loose fill packing material in bags for use as protective cushions in shipping cartons and, more particularly, to a bag sealer and cutter for use in such systems.

Loose fill packing materials are commonly poured into a cartons so as to surround and embrace articles and thereby cushion them during shipment. Such materials are typically fabricated of a variety of materials such as foamed plastics, starch and other biodegradable materials.

One problem with loose fill materials is a tendency to spill both during packaging and also at the time the cartons are opened and the articles packed in them are removed. Being light in weight, they have a tendency to fly about, and some of them exhibit a static cling which makes them particularly difficult to deal with.

Copending application Ser. No. 08/766,156 describes a system and method which overcomes the foregoing problems by packaging loose fill materials in bags made from plastic tubing to form protective cushions which can be packed about articles in shipping cartons. With the loose fill material thus confined, there is no messiness either during packing or during unpacking, the material does not fly about, and the problem of static cling is eliminated.

It is in general an object of the invention to provide a new and improved bag sealer and cutter for use in packaging loose fill packing material in bags for use as protective cushions in shipping cartons.

Another object of the invention is to provide a bag sealer and cutter of the above character which overcomes the limitations and disadvantages of tape dispensers heretofore utilized in such systems.

These and other objects are achieved in accordance with the invention by providing a bag sealer and cutter with means for guiding a portion of flexible tubing which has been gathered together along a predetermined path in a direction which is generally perpendicular to the axis of the tubing, a pair of tape applicators positioned side-by-side for simultaneously applying bands to the gathered together portion of the tubing as the tubing travels along the path, and a knife disposed in the path of the tubing after the applicators for cutting the tubing apart between the bands of tape.

Figure 8:
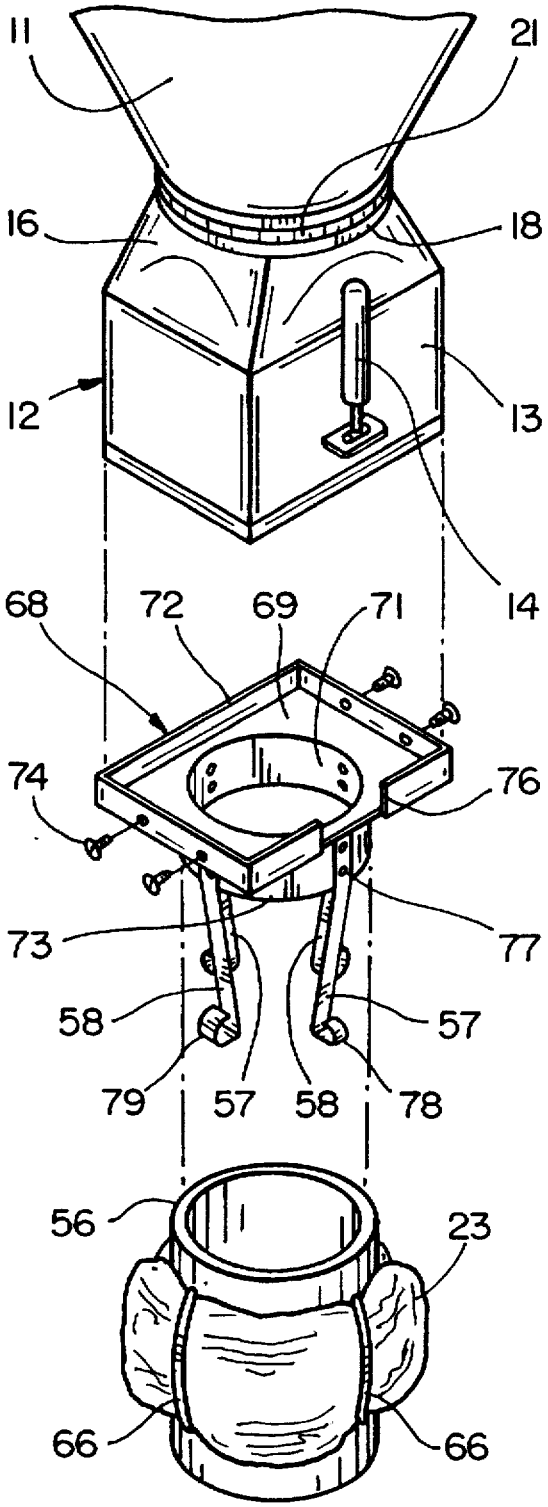
FIG. 8 is a fragmentary exploded isometric view of another embodiment of a system for bagging loose fill packing material in accordance with the invention.

FIGS. 12*a*–12*g* are operational views of the embodiment of FIG. 8.

Figure 13:
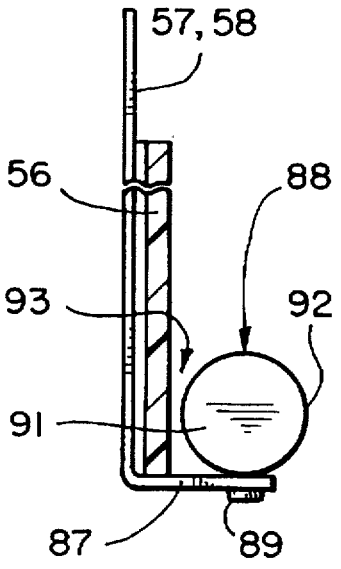
Figure 14:
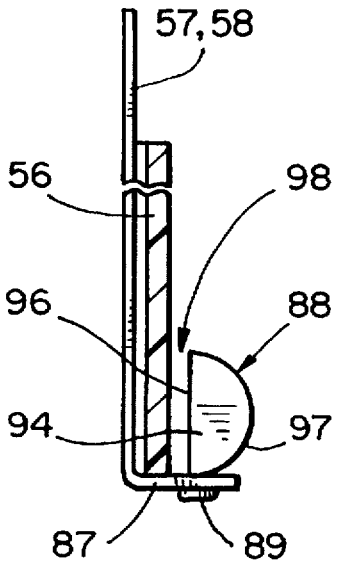

FIGS. 13 and 14 are side elevational views of additional embodiments of tubing holders for use in the embodiment of FIG. 8.

Figure 15:
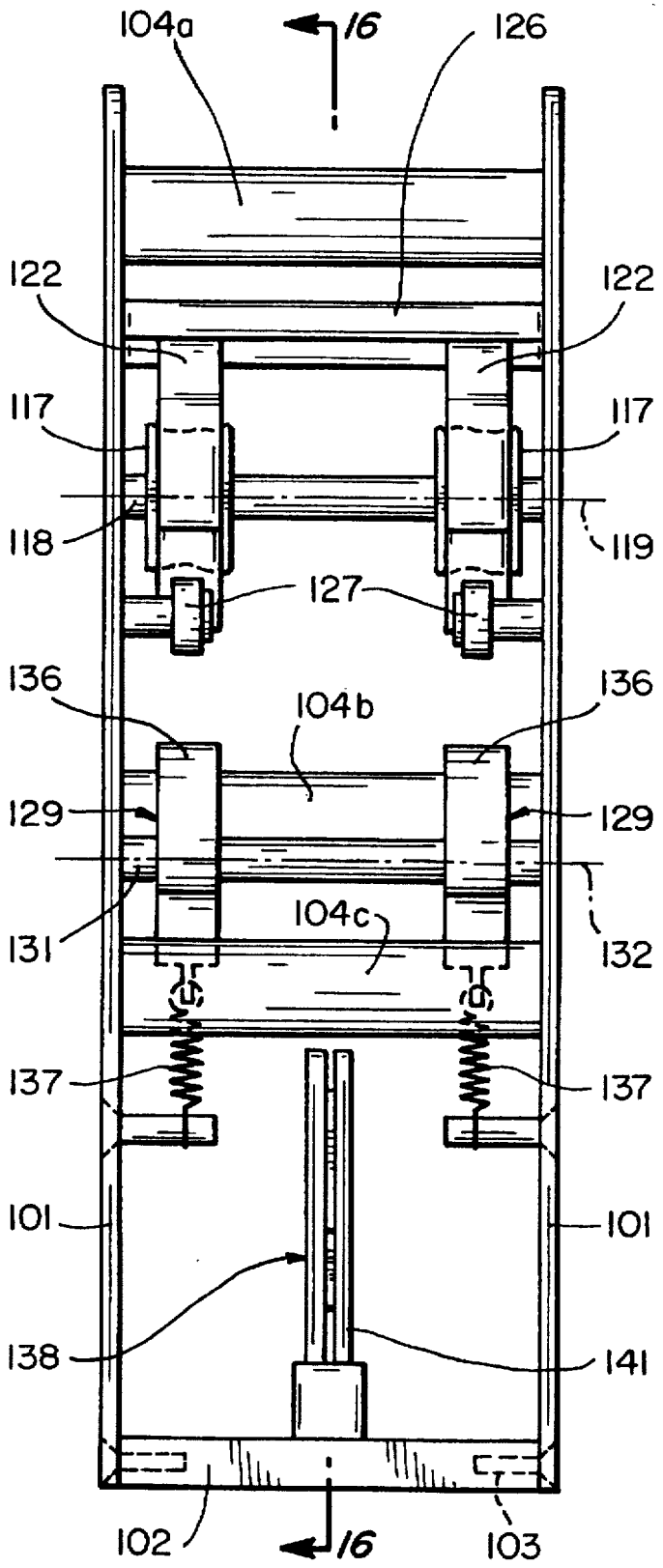

FIG. 15 is a front elevational view of an embodiment of a bag sealer and cutter for use in making protective cushions of loose fill packing material.

Figure 16:
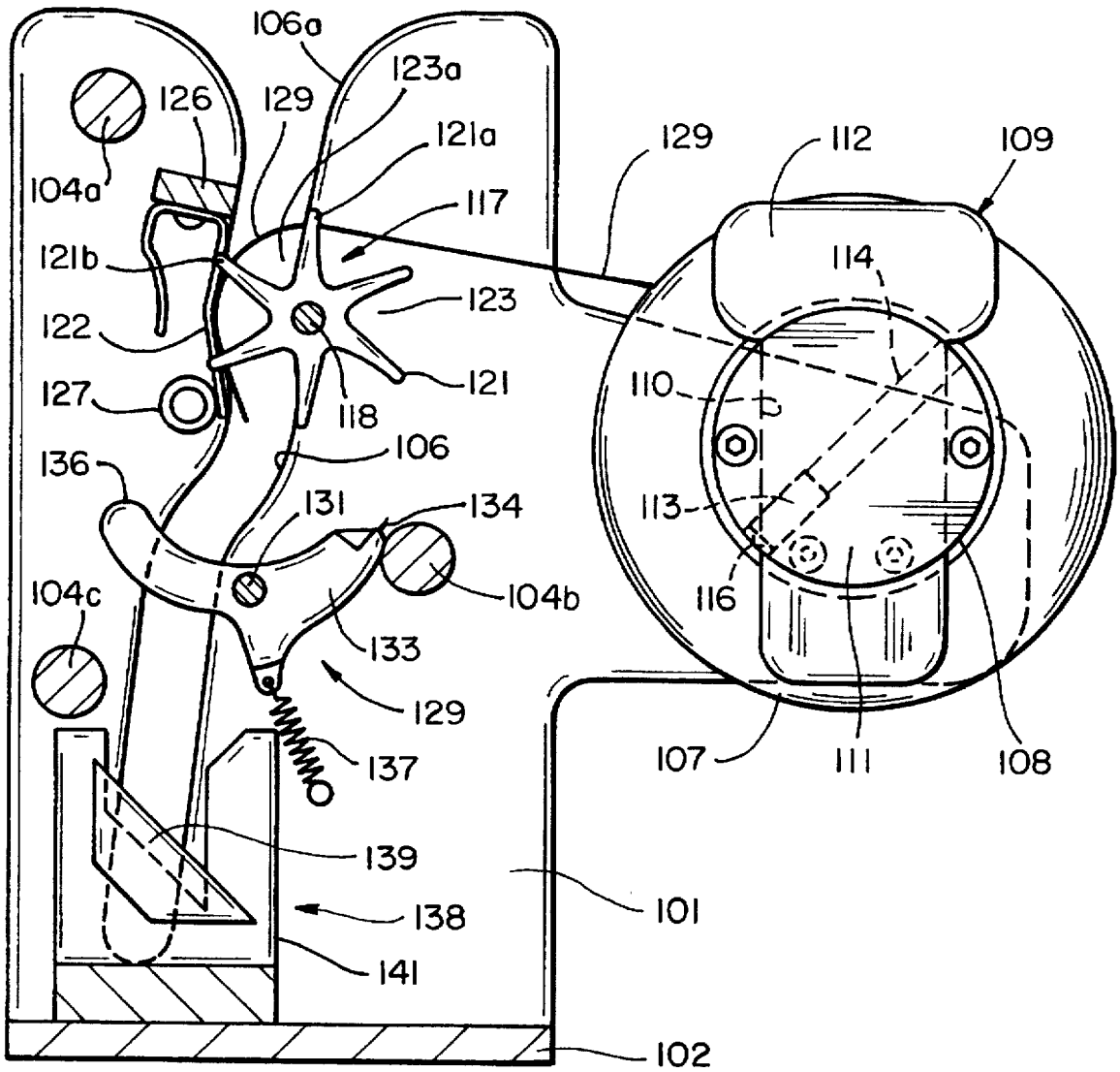

FIG. 16 is a cross-sectional view, partly broken away, taken along line 16—16 in FIG. 15.

Figure 17:
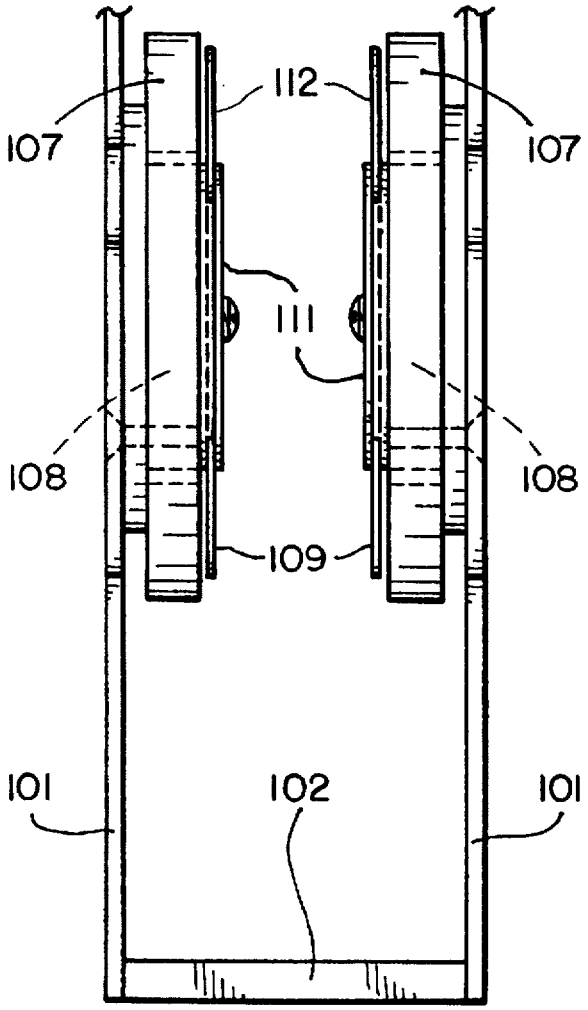

FIG. 17 is a fragmentary rear elevational view of the embodiment of FIG. 15.

Figure 18:
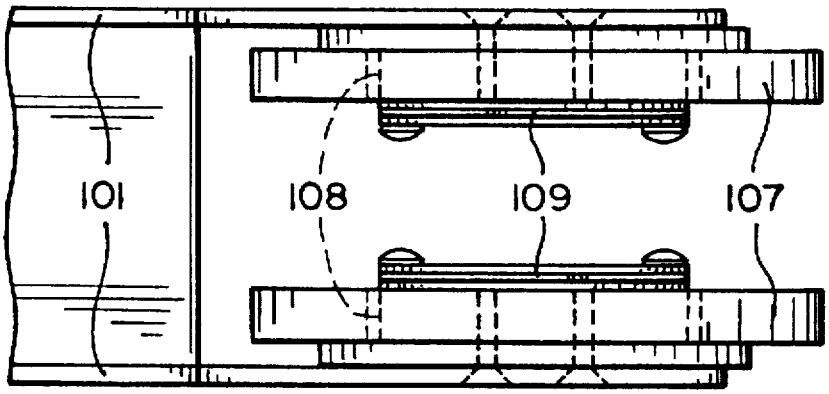

FIG. 18 is a fragmentary top plan view, partly broken away, of the embodiment of FIG. 15.

Figure 19:
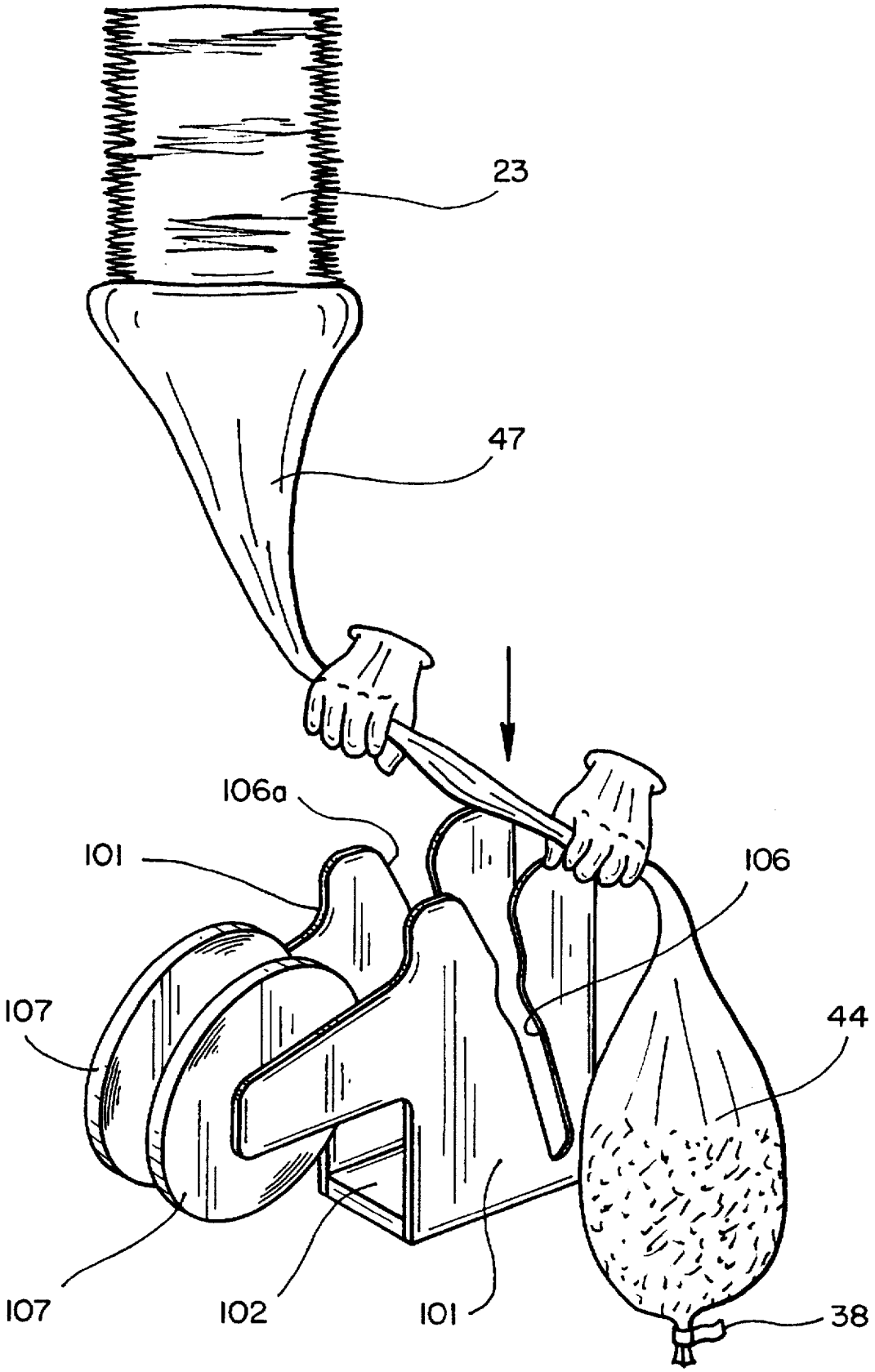

FIG. 19 is an isometric view illustrating the use of the embodiment of FIG. 15 in conjunction with a system for bagging loose fill material.

Figure 1:
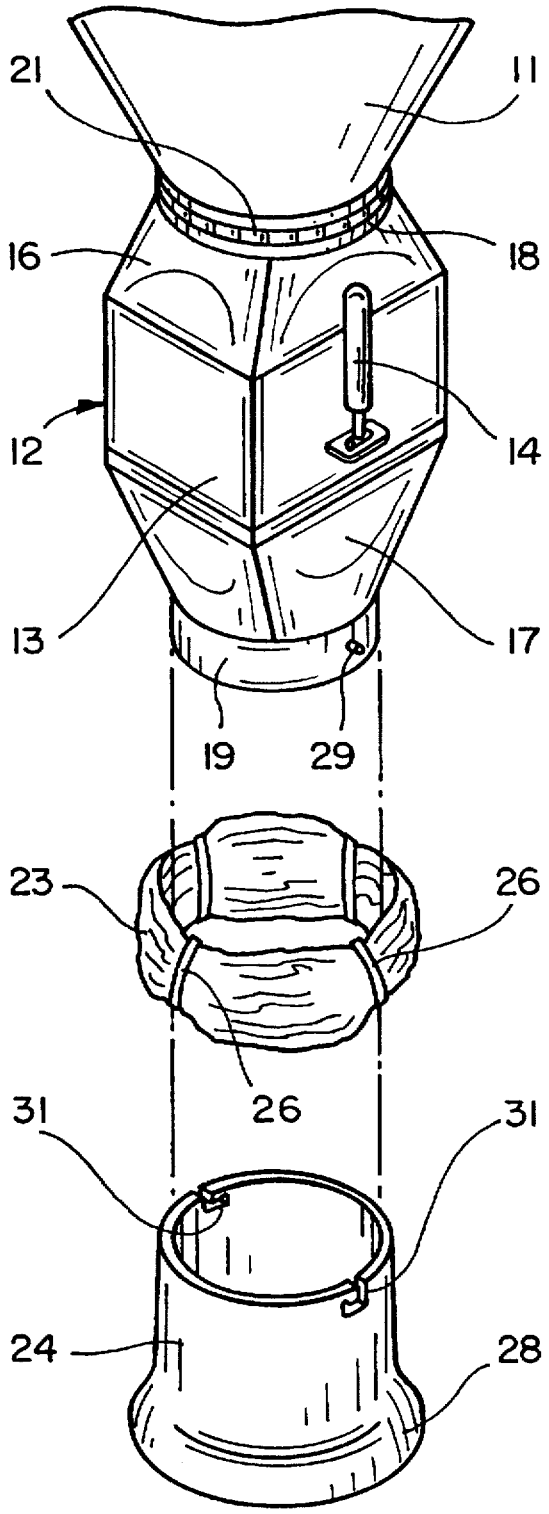
FIG. 1 is a fragmentary, partly exploded isometric view of one embodiment of a system for bagging loose fill packing material in accordance with the invention.

As illustrated in FIG. 1, the system includes a hopper 11 for holding a supply of loose fill packing material, with a valve 12 at the lower end of the hopper for dispensing the material from the hopper. The valve can, for example, be of the type disclosed in U.S. Pat. No. 4,844,291, the disclosure of which is incorporated herein by reference. It has a generally rectangular body 13 with a pair of hinged flaps (not shown) connected to an operator 14 for controlling the flow of material through the valve. The valve has transition pieces 16, 17 on its inlet and outlet sides, with circular collars 18, 19 at the outer ends thereof.

Hopper 11 comprises a tapered bag fabricated of a flexible plastic material such as polyethylene which is suspended from the ceiling or other suitable support. The upper end of the hopper bag is open, and the lower end is secured to the circular collar on the upper, or inlet, side of the valve by a band clamp 21.

On the outlet side of the valve, a length of flexible plastic tubing 23 is stored on a coil holder 24 mounted on collar 19 for use in the formation of bags for holding loose fill material dispensed through the valve. The tubing is folded and gathered in an axial direction to form a coil which is held together by suitable means such as paper tape or ties 26 until it is mounted on the coil holder. The tubing can be fabricated of any suitable material such as polyethylene, and can be of any desired weight. A polyethylene tubing having a wall thickness of 0.5 mil has been found to provide good strength and flexibility for the bags, and with a 0.5 mil material, a coil can contain several hundred feet of tubing. Other suitable materials include high density polyethylene, low density polyethylene, netting, and cellulose (paper) products.

The tubing is provided with vent holes 27 which serve to prevent air from being trapped within the tubing as the side walls are drawn together to form the cushions. The holes can be of any suitable size and spacing, and in one presently preferred embodiment, they are on the order of ½ inch in diameter and spaced on centers about 3–5 inches apart.

The lower end 28 of the coil holder is enlarged to retain the coil on the coil holder. The tubing is withdrawn from the coil holder by pulling it down over the enlarged end, with the outer diameter of the enlarged end being slightly larger than the unstretched tubing so that the tubing will remain in place unless it is pulled. In the embodiment illustrated, the enlarged end is shown as a flare. However, it can be formed in any other suitable manner such as by slotting the end portion of the cylindrical side wall and bending the tabs thus formed between the slots in an outward direction or by attaching a plurality of outwardly projecting tabs to the side wall.

The coil holder is removably mounted on outlet collar 19 by means of a bayonet mount comprising a pair of pins 29 which extend radially from the collar and are received in J-shaped slots 31 in the upper end of the cylindrical side wall of the coil holder.

Figure 4:
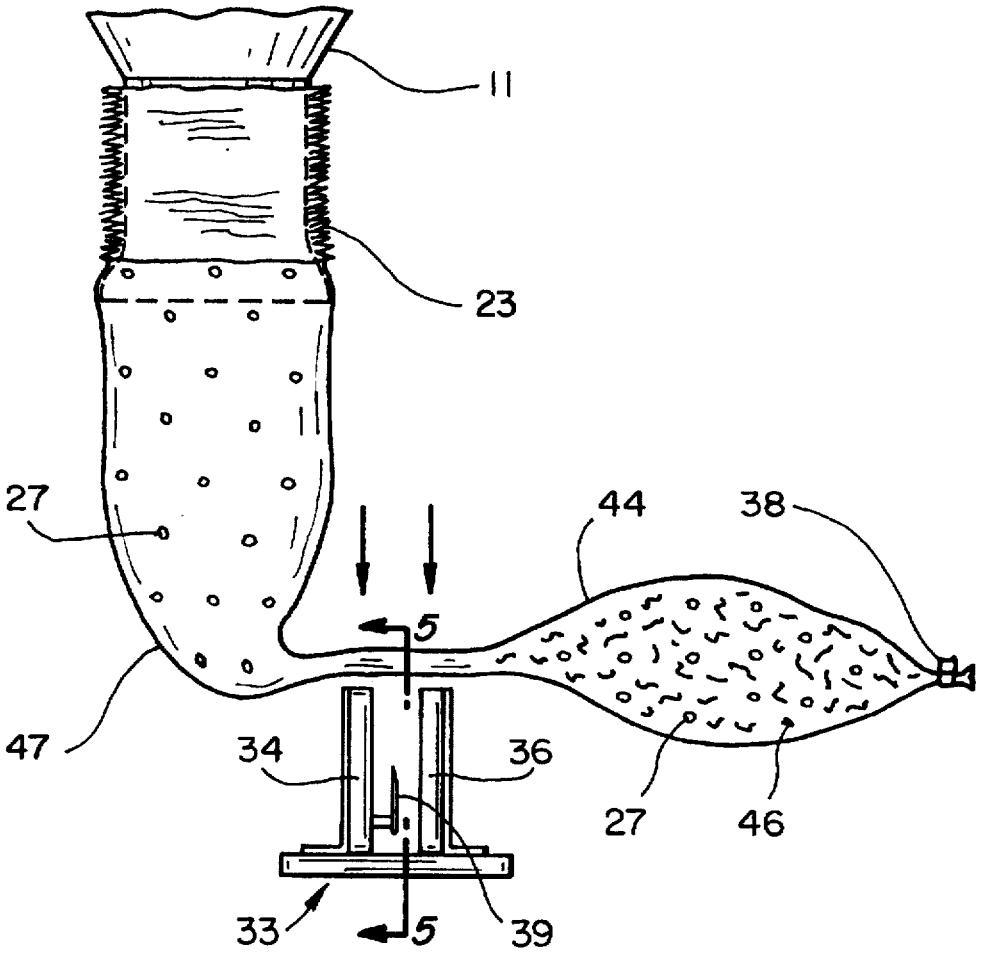
FIG. 4 is a view similar to FIG. 3, illustrating the closing and cutting of successive bags of loose fill material.
Figure 5:
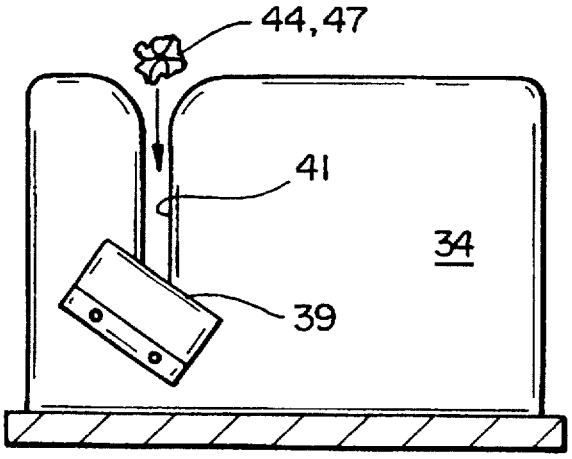
FIG. 5 is a cross-sectional view taken along line 5—5 in FIG. 4.

As illustrated in FIGS. 4–5, the system also includes a tool 33 for cutting the tubing into bag-length sections and the closing bags thus formed. This tool includes a pair of tape dispensers 34, 36 which apply bands of tape 37, 38 to the tubing after it has been drawn together, and a cutting blade or knife 39 which cuts the two sections of tubing apart between the bands of tape. Suitable tape dispensers are available commercially, and include the Jokari Model 05505 bag sealer and the Excell® EG Cut Bag Sealer, Model No. 605K.

Each of the tape dispensers has a vertically extending guide slot 41 through which the gathered walls of the tubing are drawn to trigger the application of the tape. The blade is positioned toward the lower ends of the guide slots and inclined at an angle of about 45° to the slots for slicing the tubing material immediately after it passes the point where the tape is applied.

The taping and cutting tool is positioned below and to one side of the outlet of the dispenser, within reach of the lower end of a bag which is still hanging from the coil holder. The tool can be mounted on a stand or other suitable support.

If desired, the closed ends of the tubing sections or bags can be secured with means other than tape strips. Other suitable means include metal clips, heat sealing, wire ties, plastic ties, string, and the like.

The loose fill material can be any material which is suitable for use in the cushions. Suitable materials include, but are not limited to, polystyrene, starch-based materials, paper and popcorn. It is also possible to use brittle and flaky materials which ordinarily are not suitable for use as packing materials. It is also possible to use combinations of different materials, and since they are enclosed within the bags, they will not be unsightly.

Operation and use of the system, and therein the method of the invention, are as follows. Loose fill material is introduced into the hopper from above by suitable means such as a pneumatic conveyor (not shown) or by lowering the hopper bag and pouring the material into it. Coil holder 24 is removed from the dispenser, and a coil of tubing 23 is placed on it. The coil holder is reattached to outlet collar 19, and the ties 26 which hold the coil together are removed.

Figure 3:
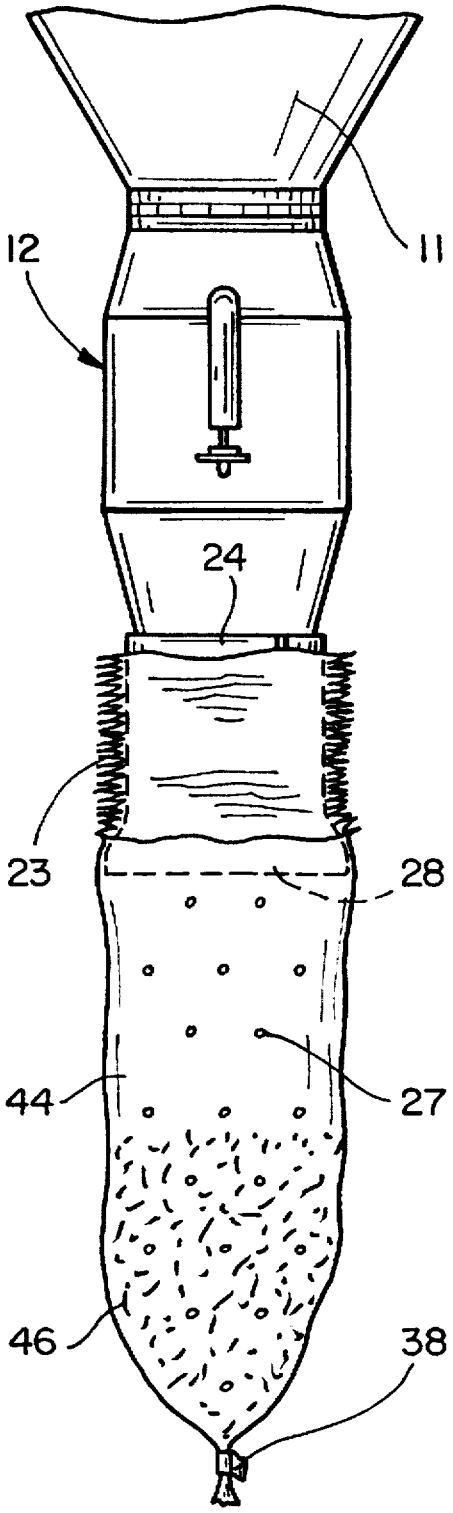
FIG. 3 is a front elevational view of the embodiment of FIG. 1, illustrating the formation and filling of a bag with loose fill material.
Figure 2:
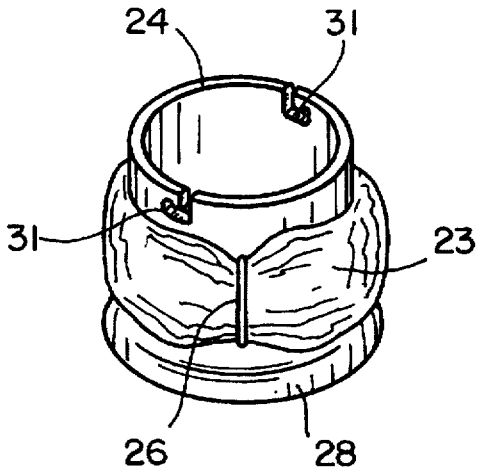
FIG. 2 is an isometric view of the coil holder with tubing from which bags are formed in the embodiment of FIG. 1.

A first section of tubing 44 is withdrawn from the coil by pulling it down over the enlarged lower end 28 of the coil holder, and the lower end of that section is drawn together and taped to form a bag which hangs from the dispenser, as illustrated in FIG. 3. The valve is then opened to discharge a predetermined amount of the loose fill material 46 into the bag.

After the bag has been filled to the desired level, a second section of tubing 47 is withdrawn from the coil, and the portion of the tubing between the two sections is drawn together and passed through taping and cutting tool 33. As the material is pressed into the tool and passes in a downward direction through the guide slots 41, bands of tape 37, 38 are applied simultaneously to the upper end of section 44 and to the lower end of section 47 to secure those ends in the closed position. The downward motion of the tubing then brings it into contact with blade 39 which severs the tubing between the two bands of tape, thereby separating the filled bag or cushion 49 formed by section 44 from section 47.

This process is repeated to form additional bags or cushions from successive sections of the tubing. In many applications, it has found to be desirable to fill the bags only about half full. That permits the objects being packed to nestle into the cushions, with the material in the cushions encompassing the objects to better protect them.

Figure 6:
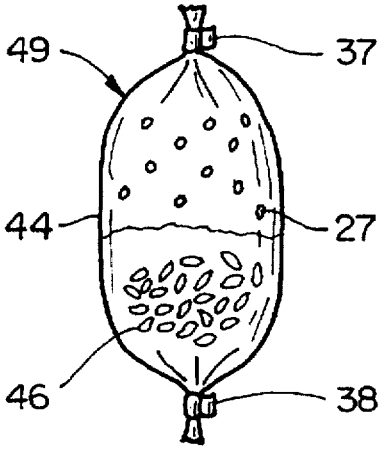
FIG. 6 is an isometric view of a bag filled with loose fill packing material in accordance with the invention.

A finished cushion is illustrated in FIG. 6. As discussed more fully hereinafter, it is used by placing it and other cushions like it about an article in a carton. With the loose fill material enclosed in the cushion, there is no spillage of material during the packaging process.

When the carton is opened and the articles inside it are removed, there is no spillage or other mess with loose fill materials, and there is no need to dig for the articles in the material. The cushions are simply removed from the carton as needed to provide access to the articles. The cushions remain in tact, with the loose fill material fully contained within them, and they can be recycled, reused, or disposed of, as desired.

Figure 7:
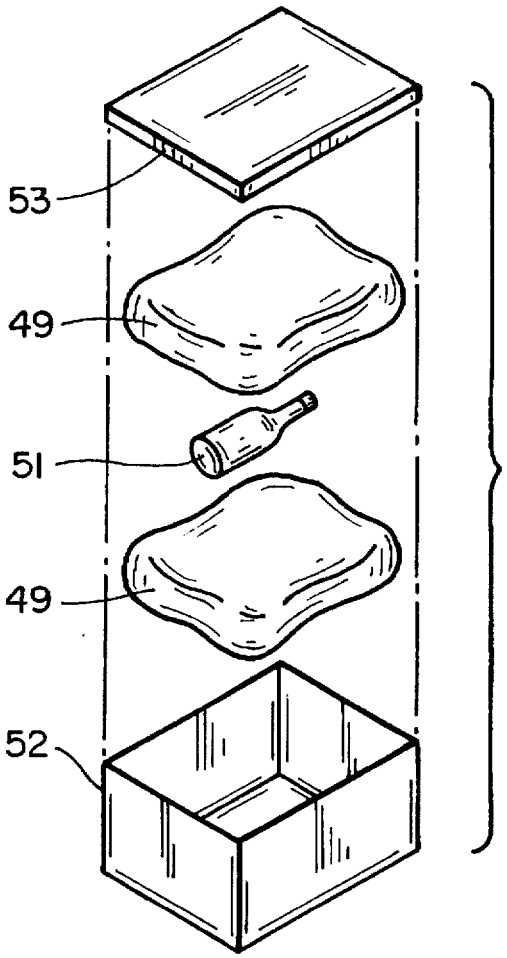
FIG. 7 is an exploded isometric view of an article packed with cushions in accordance with the invention.

In some applications it may be desirable to compress the cushions before they are placed in the carton, then allow them to expand about the article(s) to be protected. Such an application is illustrated in FIG. 7 in conjunction with the packaging of an article 51 in a carton or container 52 which has a removable lid or top 53. The article is illustrated as being in the form of a bottle, but it can be anything that needs to be protectively packaged. The container is illustrated as being a cardboard box, but it can be any container which is suitable for packaging or shipping the article. The lid can be secured to the container by any suitable means such as taping or stapling.

In this embodiment, the tubing from which the bags are formed is unvented (i.e., without vent holes 27), and after the bags are closed, air and/or other gases or fluids are withdrawn from them to reduce the pressure within them to a level below that of the surrounding environment, e.g. below atmospheric pressure. That is conveniently done by piercing each bag with a lance or needle connected to a vacuum pump. The difference in the air pressures inside and outside the bags compresses the fill material until the resilient force of the material counterbalances the compressive force applied by the pressure differential. The interiors of the cushions are thereafter repressurized to re-expand the fill material to conform to contours of the article and the interior walls of the container. The cushions can be re-expanded and used immediately after compression, or they can be sealed for storage and/or shipment in the compressed state.

If desired, recyclable, biodegradable, and/or water-soluble materials can be used either for the tubing or for the fill material, or both.

For the tubing, suitable recyclable materials include Saran, ethylene vinyl acetate (EVA), polyethylene film, paper, and the like. Suitable water-soluble materials include polyvinyl alcohol (PVOH) based materials, and hydrocarbon based alloys, such as the Enviroplastic-H based on polyoxyethylene, for example. Suitable biodegradable materials include water-soluble polyvinyl alcohol (PVOH) based films; poly-caprolactone-alphatic ester based materials; polyhydroxybutyrate-valerate (PHBV) copolymers; polyoxyethylene based materials; polyester based compostable material; starch based biopolymer materials; and other starch based materials such as those that include a catalyst to enhance photo and oxidative degradation.

For the fill material, suitable recyclable materials include extruded polystyrene (EPS) beads and other materials which are neither biodegradable nor water soluble. Suitable biodegradable materials include starch graft copolymer materials, starch biopolymer materials, wood chips and shavings, plant fibers, twigs, seeds, popcorn, and the like. Suitable water soluble materials include starch based materials and other water soluble materials. Where vented tubing is used for the bags, the particles of fill material should, of course, be larger than the vent openings to prevent spillage from the bags.

FIG. 8 illustrates an embodiment in which the tubing 23 is gathered or bunched onto a cylindrical core 56 that is mounted on a plurality of flexible fingers 57, 58 at the outlet side of dispensing valve 12. The core is fabricated of a relatively stiff material such as cardboard and has a diameter on the order of 6 to 7 inches and a length on the order of 12 to 14 inches.

Figure 9:
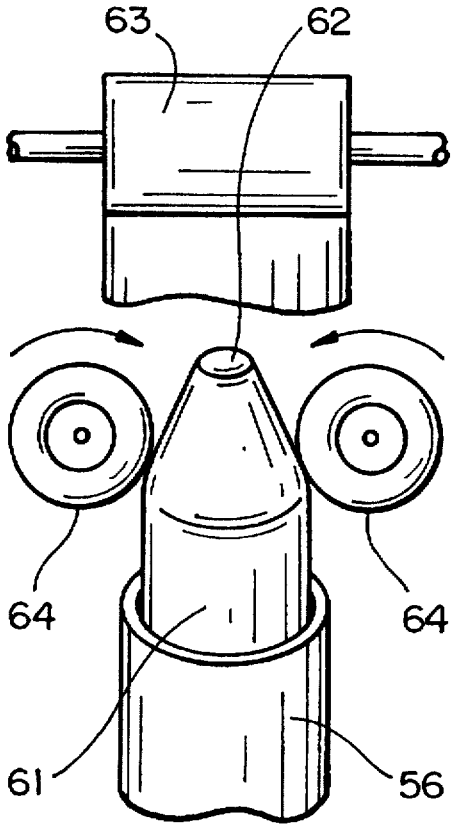
FIG. 9 is an isometric view, somewhat schematic, of a system for gathering tubing onto a cylindrical core for use in the embodiment of FIG. 8.

In one presently preferred embodiment, the tubing is gathered or bunched onto the core by means of a machine 59 which is illustrated somewhat schematically in FIG. 9. That machine has an upstanding mandrel 61 on which the core is mounted. The upper end 62 of the mandrel is tapered, and the tubing is fed onto the mandrel over the tapered end from a supply roll 63. A plurality of motorized rollers 64 at the base of the taper feed the tubing onto the core where it is gathered or bunched and secured by paper tape or ties 66. A machine of this type is available commercially from Newtec USA, Inc., Butler, Pa. (Model NS 57-A automatic sleeving machine).

Fingers 57, 58 are arranged in two pairs which are disposed in quadrature about the outlet of the valve. They are mounted on a transition piece 68 which consists of a rectangular base plate 69 with a circular opening 71, peripheral mounting flanges 72 which extend in an upward direction from the edges of the base plate, and a circular collar 73 which surrounds opening 71 and depends from the plate. Flanges 72 fit over the lower portion of valve body 13 and are secured to the valve body by mounting screws 74, with a cut-out 76 in one of the flanges providing clearance for valve actuator 14. The fingers are attached to the collar by suitable means such as rivets 77.

The fingers are formed of a resilient material such as sheet metal, and are biased toward a retracted or rest position in which they extend downwardly and inwardly from the mounting collar. As discussed more fully hereinafter, the fingers can be spread apart for engagement with the core but return to their retracted or rest position when the core is removed.

Means is provided at the lower ends of fingers 57, 58 for retaining core 56 on the fingers and the tubing 23 on the core. In the embodiment of FIG. 7, the fingers are formed from strips of sheet metal, and the lower portions of the strips are bent outwardly and upwardly to form hooks 78, 79 which retain the core and tubing.

The hooks on the two pairs of fingers are generally similar in shape and in lateral dimension, but different in vertical dimension. This enables the core to be engaged with and disengaged from the hooks in the two pairs at different times, which makes it easier for one person to install and remove the core.

Figure 10:
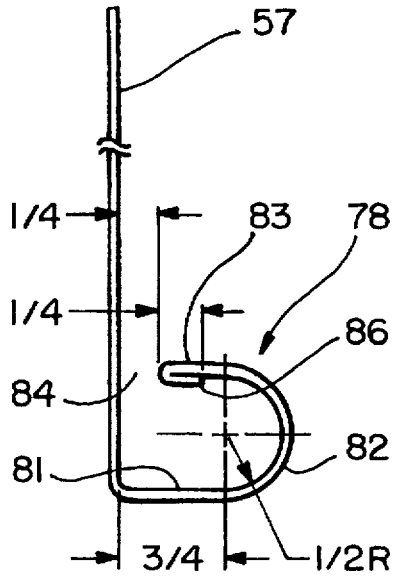
FIGS. 10 and 11 are side elevational views of the tubing holders in the embodiment of FIG. 8.
Figure 11:
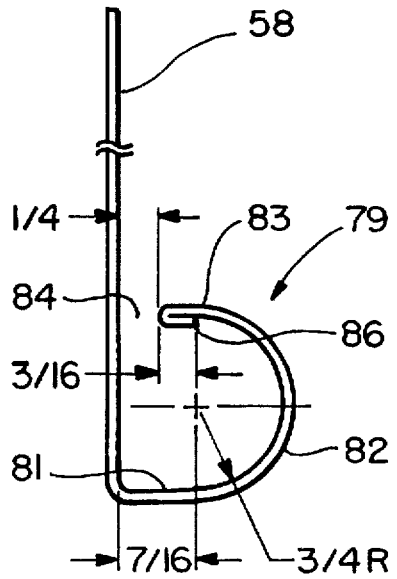
Figure 12A:
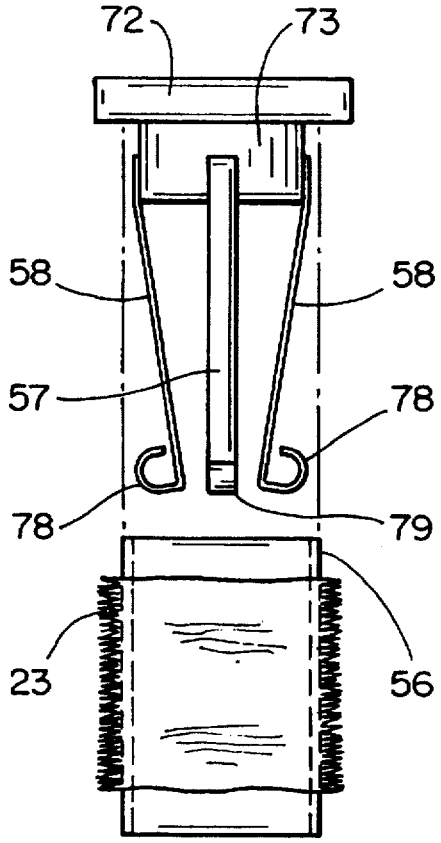
Figure 12B:
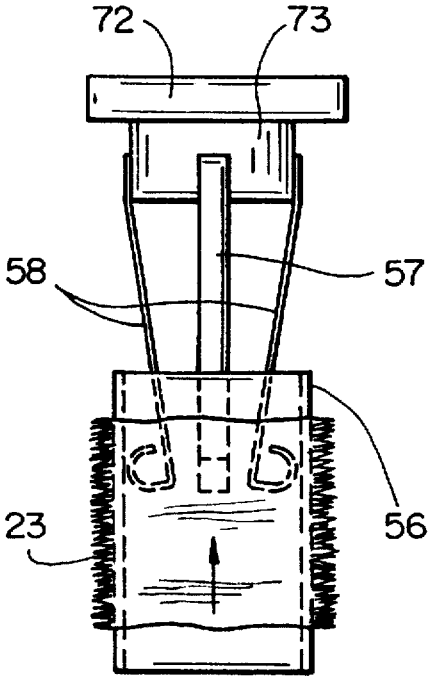
Figure 12C:
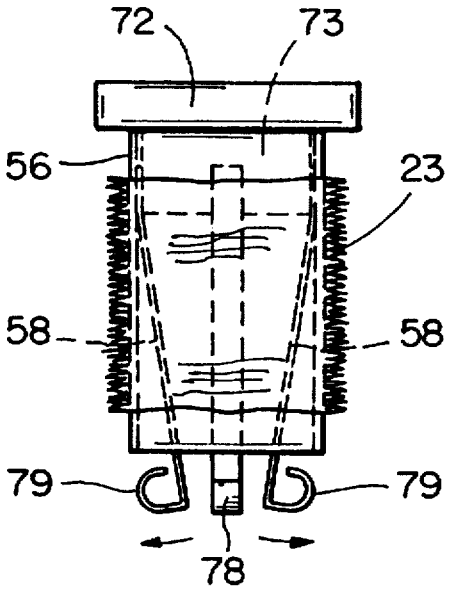
Figure 12D:
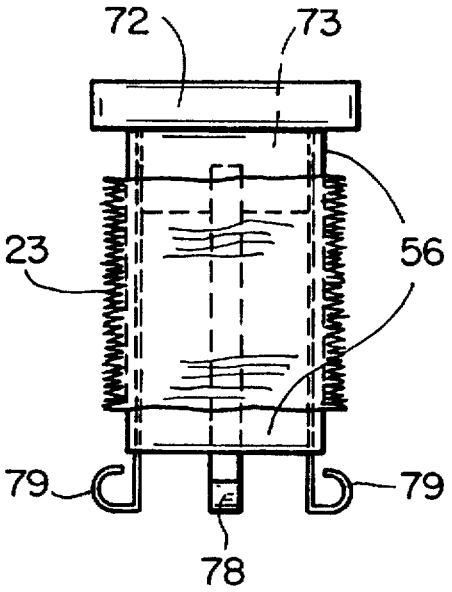
Figure 12E:
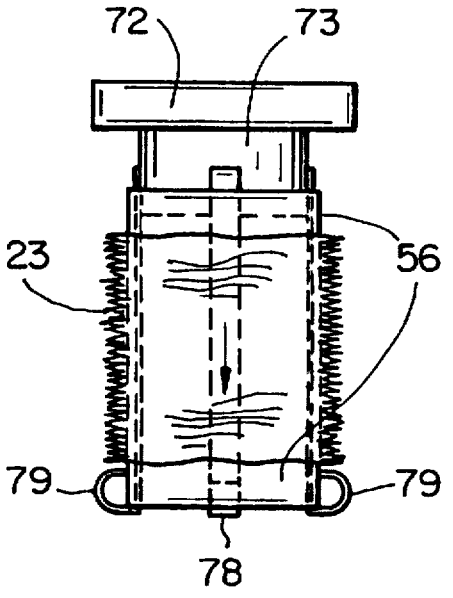
Figure 12F:
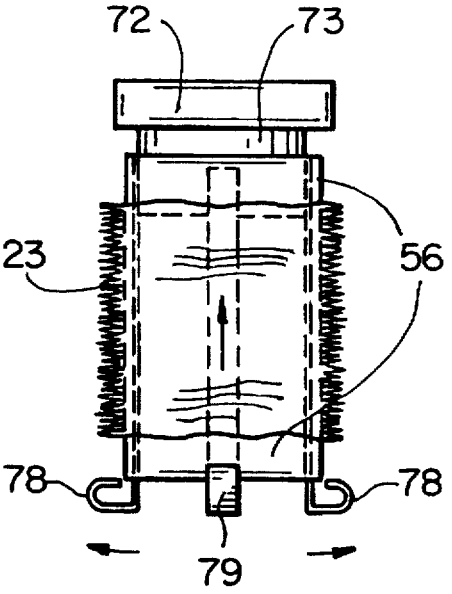
Figure 12G:
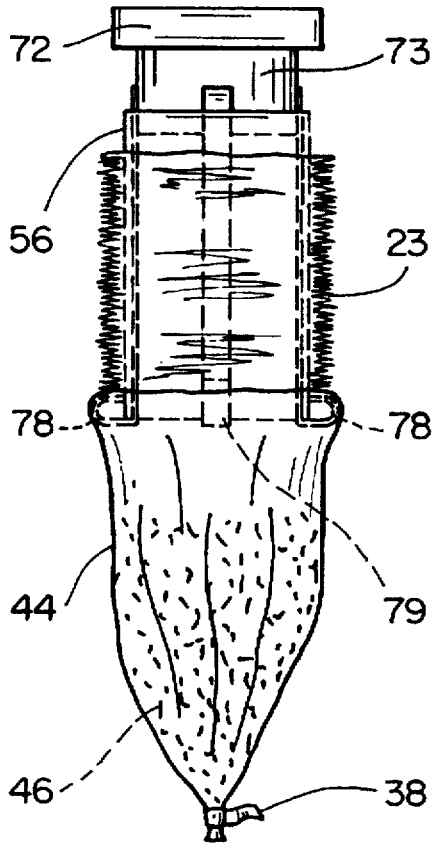

As illustrated in FIGS. 10 and 11, each of the hooks has a horizontally extending section 81 at the lowermost end of the finger, a semi-cylindrical side section 82 which extends upwardly from the outer end of lower section 81, and a horizontal section 83 which extends in an inward direction from the upper end of the side section. The upper section terminates a short distance from the finger to form an opening or gap 84 through which the lower portion of core 56 can pass. The end portion 86 of the strip is folded under to provide a smooth edge at the opening.

In one present embodiment, fingers 57, 58 are all of equal length (16⅝ inches), and hooks 79 are ½ inch taller than hooks 78. In hooks 78, lower section 81 is ¾ inch long, side section 82 has a ½ inch radius of curvature, and upper section 83 is ½ inch long. In hooks 79, lower section 81 is 7/16 inch long, side section 82 has a ¾ inch radius of curvature, and upper section 83 is 3/16 inch long. In both hooks, the gap 84 between the finger and the inner end of upper section 83 is ¼ inch. The lower sections of all four of the hooks lie in the same horizontal plane, and the lower edge of core 56 rests upon the upper surfaces of those sections.

The diameter of collar 73 is slightly less than that of the core, and when the core is mounted on the fingers and engaged with the hooks, fingers 57, 58 extend longitudinally within the core near the inner surface of the cylindrical side wall, with hooks 78, 79 projecting laterally beyond the core and the curved side sections of the hooks engaging the inside of the tubing at the lower end of the core. That engagement permits successive sections of the tubing to be pulled axially from the core while the remainder of the tubing remains in place on the core.

As illustrated in FIGS. **12*a*–12*g*, the core is installed by positioning it beneath the discharge opening of the valve and lifting onto the fingers to a level such that the bottom edge of the core is above all four of the hooks. The lower ends of the fingers with the larger hooks, i.e. fingers 58, are then spread apart, and the core is lowered into those hooks, i.e. hooks 79. Once the core has been engaged with hooks 79, the operator can release it, and those hooks will hold it in place. To engage hooks 78, the core is raised until its lower edge clears the tops of those hooks and fingers 57 can be spread to position the openings in the hooks beneath the wall of the core. Since hooks 79 are taller than hooks 78, the lower portion of the core will remain within hooks 79 while the fingers carrying hooks 78 are being spread. The core is then lowered into the four hooks, with the lower edge of the core resting upon hook sections 81**.

Once the core has been installed, the ties are removed, and successive lengths of tubing are withdrawn, filled, closed and severed to form the cushions as in the embodiment of FIG. 1. As noted above, the outer surfaces of the hooks engage the inside of the tubing passing over them, allowing successive sections of the tubing to be pulled off the core while retaining the remainder of the tubing on the core.

The core is removed by lifting it until the lower edge of the core is above the upper portions of all four hooks. With the hooks disengaged from the core, fingers retract to their rest position, and the core can drop freely over them.

FIGS. 13 and 14 illustrate embodiments similar to the embodiment of FIG. 8, with different means at the lower ends of the fingers for retaining the core on the fingers and the tubing on the core. In each of these embodiments, the lower portions of fingers 57, 58 are bent in an outward direction to form flanges 87 upon which blocks 88 are mounted to form hooks or holders for retaining the core and the on the fingers and the tubing on the core. The blocks are secured to the flanges by suitable means such as screws 89, with the outer portions of the blocks projecting laterally beyond the outer ends of the fingers.

In the embodiment of FIG. 13, blocks 88 consist of lengths of solid rod 91 of circular cross-section which are oriented with the axis of the rod parallel to the plane of finger on which it is mounted. These blocks have a cylindrical side wall 92, the innermost portion of which is spaced from the outer surface of the finger to form an opening 93 for receiving the lower portion of the core.

The outer portion of the side wall engages the inside of the tubing and prevents the tubing from dropping off the core.

In the embodiment of FIG. 14, blocks 88 consist of lengths of solid rod 94 of semicircular cross-section which are oriented with the axis of the rod parallel to the plane of finger on which it is mounted. These blocks have a planar inner side wall 96 and a semi-cylindrical outer side wall 97, with inner wall being spaced from the outer surface of the finger to form an opening 98 for receiving the lower portion of the core. The semi-cylindrical side wall engages the inside of the tubing and prevents the tubing from falling off the core.

Operation and use of the embodiments of FIGS. 12 and 13 is similar to that of the embodiment of FIG. 8. The lower portion of core 56 passes through the opening between the block and finger, and rests upon the upper surfaces of flanges 87. If desired, the blocks can be of different vertical dimension to facilitate installation of the core as in the embodiment of FIG. 8.

If desired, the loose fill material can be dispensed directly into a carton in the embodiments of FIGS. 8–14 simply by removing the core from the fingers and placing the carton beneath the outlet of the valve.

FIGS. 15–18 illustrate a bag sealer and cutter which is particularly suitable for use in this system for closing end portions of the tubing to form the bags and severing one section of the tubing from the next as the bags are filled and sealed.

This tool has a pair of spaced apart side plates 101 affixed to a base 102 by screws 103, with spacers **104*a*–104*c* extending between the plates above the base. The base is adapted to be mounted on a suitable support such as a tool post (not shown) below and to one side of the dispenser outlet. Aligned slots 106 in the side plates define a path for the tubing, and the mouth 106*a*** of the slots is tapered to assist in drawing the tubing together between successive sections to form the bags.

Two rolls 107 of sealing tape are rotatively mounted between the plates on one side of the path for application to the tubing to seal the bags. Each of the rolls is mounted on a holder which has a cylindrical hub 108 that extends through the opening in the core of the tape roll. The outer ends of the hubs are affixed to the side plates, and the tape roll is retained on each of the hubs by a keeper plate or key 109 which is removably mounted in a vertically extending slot 110 toward the inner end of the hub. In the embodiment illustrated, the slot is formed in the inner face of the hub and closed by a circular cover 111 which is screwed onto the inner face. The keeper plate or key has an enlarged head 112 which prevents it from passing all the way through the slot when inserted into it from above.

Means is included for providing controlled resistance to rotation of the tape rolls on the hubs. That means includes a ball plunger 113 which is mounted in a diametrically extending threaded bore 114 in each of the hubs. The plunger includes a ball 116 which is urged against the inner face of the tape roll core by an internal coil spring (not shown). Rotation of the tape roll is resisted by a combination of the drag of the ball on the core and friction between the core and the surface of the hub on the side of the hub opposite the plunger. The amount of force with which the ball engages the core, and hence the amount of resistance to rotation of the core, can be adjusted by turning the plunger with a screwdriver inserted into the bore from the back side of the plunger to change the position of the plunger within the bore.

Tape from the rolls is applied to the tubing by a pair of star wheels 117 which are affixed to an axle 118 for rotation in concert about an axis 119 which is generally perpendicular to the path defined by the slots. The star wheels have radial fingers or teeth 121 which extend across the path and are engaged in driving relationship by the tubing travelling along the path and through the wheels. Arcuately curved leaf springs 122 are disposed peripherally of the star wheels on the other side of the slots to keep the tubing in the openings 123 between the teeth and to help in the application of the tape to the tubing. In the embodiment illustrated, the star wheels each have six teeth, and the leaf springs have an arc length somewhat greater than 60° so that they span the distance between adjacent pairs of the teeth.

The leaf springs are mounted on a bar 126 which extends between the side plates. Stops 127 are mounted on side plates 101 toward the lower ends of the springs to limit outward travel of the springs and prevent them from being deflected too far away from the outer ends of the teeth on the star wheels.

The star wheels have a rest position in which one of the teeth **121*a* on each wheel extends in an upward direction in alignment with one edge of the path and the tooth 121*b* adjacent to it extends across the path, with the path leading into the space 123*a*** between these teeth.

The tape 129 from rolls is trained about the outer ends of teeth **121*a*, 121*b* and extends along the inner faces of the leaf springs, with the outer ends of the teeth being notched for the tape. The sticky side of the tape faces up and adheres to the faces of the springs. As the gathered tubing is pushed down the path into the star wheels, the tape is depressed into the opening 123*a* ahead of the tape, and more tape is drawn from the rolls. As the tape is pressed against teeth 121*b***, the wheels turn in a downward direction, and the tape is peeled off the faces of the springs and wrapped in bands about the tubing.

As the wheels turn, additional tape is withdrawn from the rolls and deposited along the faces of the springs. When opening **123*a* is aligned with the lower portion of the path, the tubing moves out of engagement with teeth 121*b*** and exits the wheels as it continues its travel down the path.

A pair of cutters 129 are mounted beneath the star wheels for cutting the tape leading from the leaf springs to the tubing after the bands of tape have been applied. The cutters are affixed to a shaft 131 for movement in concert about a pivot axis 132. Each of the cutters has a first arm 133 which carries a cutting blade 134, and a second arm 136 which extends across the path of the tubing when the cutters are in a rest position. Springs 137 bias the cutters toward the rest position, with arms 136 abutting against spacer **104*b*** in that position. Since the tape is trained about the star wheels, those wheels continue to turn until the tape is cut, and the position of the cutters is such that the star wheels will be left in their rest position when the cuts are made.

When the tubing engages arms 136, the cutters pivot in a counter-clockwise direction, as viewed in FIG. 16, bringing blades 134 into cutting engagement with the webs of tape between the tubing and the leaf springs. As the tubing continues to travel and moves out of engagement with arms 136, the cutters return to their rest position.

A knife 138 is mounted on base 102 toward the lower end of the slots for severing the tubing between the sections after the bands of tape have been applied. In the embodiment illustrated, the knife consists of a blade 139 mounted in a holder 141 affixed to the base. The blade lies in a plane which is midway between side plates 101 and parallel to them, with the blade being inclined downwardly and rearwardly at an angle on the order of 45° to provide a slicing action as the tubing moves past it.

Operation and use of the bag sealer and cutter in the bagging of loose fill packing material can be summarized as follows. After a section of tubing is filled with the loose fill material, another section is drawn from the supply on the dispensing valve, and the portion of the tubing between the two sections is drawn together to close the bag, as illustrated in FIG. 19, and pushed briskly along the path defined by slots 106, with the axis of the tubing generally perpendicular to side plates 101. As the tubing enters the slots, with the tapered mouths 106*a* of the slots help in gathering it together to close the ends of the bags which are being formed.

As the tubing travels down the slot, it turns star wheels 117, causing them to apply two band of tapes to the gathered tubing to simultaneously seal the upper end of the bag which has just been filled and the lower end of the bag which is being formed from the next section of the tubing.

When the tubing engages cutter arms 136, the cutters pivot, and blades 134 cut the tape just above the bands. The tubing then engages knife blade and is severed between the bands, leaving one bag which has been filled and sealed at both ends and one which has been sealed at one end and is ready to be filled.

While the embodiment of FIGS. 15–18 has been described with specific reference to use in the bagging of loose fill packing material, it can also be used in other applications where multiple bands of tape are applied to a material and the material is then cut apart between the bands.

The invention has a number of important features and advantages. It enables packing cushions to be manufactured at the point of use from plastic tubing and loose fill materials without the spillage and mess normally associated with such materials. The bag sealer and cutter seals adjacent ends of two bags simultaneously, then cuts the tubing to separate the bags in a single operation.

The invention also eliminates the problems of messiness and spillage at the receiving end when the cartons are opened and the articles packed therein are removed. Being contained in the cushions, the loose fill material will not tend to cling to the articles packed in it or to the hands and arms of a person removing the articles from it. The cushions also prevent the packaged goods from contact with materials such as starch which tend to absorb water and become soggy during humid conditions. The cushions can be molded to the shape of the articles to be protected, and tend to provide better protection than a loose body of material. If desired, advertising and/or other messages can be printed on the bags.

It is apparent from the foregoing that a new and improved system and method for bagging loose fill packing materials has been provided. While only certain presently preferred embodiments have been described in detail, as will be apparent to those familiar with the art, certain changes and modifications can be made without departing from the scope of the invention as defined by the following claims.

We claim:

1. Apparatus for packaging loose fill packing material in bags for use as protective cushions in shipping cartons, comprising:

a dispenser having an outlet through which loose fill packing material is discharged;

a supply of flexible plastic tubing disposed coaxially of the outlet such that successive sections of the tubing can be drawn from the supply into communication with the outlet for receiving the loose fill material discharged through the outlet;

means for gathering a portion of the tubing together between the successive sections and guiding the gathered portion along a predetermined path in a direction which is generally perpendicular to the axis of the tubing;

first and second rolls of sealing tape positioned beside the path;

a pair of tape applicators positioned side-by-side and connected together for rotation in concert about an axis which is generally perpendicular to the path for simultaneously applying a band of tape from each of the two rolls to the gathered portion of the tubing as the tubing travels along the path; and a knife disposed in the path of the tubing after the applicators for cutting the tubing between the bands of tape to separate the sections.

2. The apparatus of claim 1 wherein the tape applicators comprise star wheels having radially extending teeth which are engaged by the tubing travelling along the path to turn the wheels.

3. The apparatus of claim 2 including arcuately curved leaf springs disposed peripherally of the star wheels for retaining the tubing between the teeth as the tubing travels past the wheels.

4. The apparatus of claim 1 further including a pair of cutters positioned between the applicators and the knife and connected together for movement in concert about an axis for cutting the tape after the bands are applied.

5. The apparatus of claim 4 wherein the cutters include arms which are engaged by the tubing to pivot the cutters about the pivot axis and into engagement with the tape.

6. The apparatus of claim 1 wherein each of the rolls of tape is rotatively mounted on a hub which includes a plunger biased in a radial direction into engagement with the roll for yieldably resisting rotation of the roll on the hub.

7. The apparatus of claim 1 wherein each of the rolls of tape is rotatively mounted on a hub having a keeper plate removably mounted in a slot toward one end of the hub for retaining the roll on the hub.

8. Apparatus for use in bagging loose fill packing material in the manufacture of protective cushions for use in shipping cartons, comprising:

a pair of side plates;

aligned slots in the side plates for guiding a closed down portion of a length flexible plastic tubing along a predetermined path with the axis of the tubing generally perpendicular to the path;

first and second rolls of tape rotatively mounted between the plates;

a pair of star wheels mounted side-by-side between the plates and connected together for rotation about an axis which is generally parallel to the axis of the tubing for simultaneously applying a band of tape from each of the two rolls to the closed down portion of the tubing as the tubing travels along the path;

a pair of cutters mounted side-by-side between the plates and connected together for movement in concert about an axis for cutting the tape after the bands are applied; and a knife mounted between the plates and in the path of the tubing for cutting the tubing between the bands as the tubing travels along the path beyond the cutters.

9. The apparatus of claim 8 wherein the star wheels have radially extending teeth which are engaged by the tubing travelling along the path to turn the wheels.

10. The apparatus of claim 9 including arcuately curved leaf springs disposed peripherally of the star wheels for retaining the tubing between the teeth as the tubing travels past the wheels.

11. The apparatus of claim 8 wherein the cutters include arms which are engaged by the tubing to pivot the cutters about the pivot axis and into engagement with the tape.

12. The apparatus of claim 8 wherein each of the rolls of tape is rotatively mounted on a hub which includes a plunger biased in a radial direction into engagement with the roll for yieldably resisting rotation of the roll on the hub.

13. The apparatus of claim 8 wherein each of the rolls of tape is rotatively mounted on a hub having a keeper plate removably mounted in a slot toward one end of the hub for retaining the roll on the hub.

14. Apparatus for sealing and separating bags formed from a length of flexible plastic tubing, comprising:

means for guiding a portion of the tubing which has been gathered together along a predetermined path in a direction which is generally perpendicular to the axis of the tubing;

a pair of tape applicators positioned side-by-side and connected together for rotation in concert about an axis which is generally perpendicular to the path for simultaneously applying bands of tape to the gathered together portion of the tubing as the tubing travels along the path; and a knife disposed in the path of the tubing after the applicators for cutting the tubing apart between the bands of tape.

15. The apparatus of claim 14 further including a pair of cutters positioned between the applicators and the knife for cutting the tape after the bands are applied.

* * * * *